US005874809A

United States Patent [19]

Hagen

[11] Patent Number: 5,874,809

[45] Date of Patent: Feb. 23, 1999

[54] CONSTANT LIGHT OUTPUT BALLAST CIRCUIT

[76] Inventor: Thomas E. Hagen, 9041 Cheshire La., Maple Grove, Minn. 55369

[21] Appl. No.: 807,058

[22] Filed: Feb. 27, 1997

[51] Int. Cl.[6] ..... H05B 37/02

[52] U.S. Cl. ..... 315/224; 315/247; 315/209 R; 315/244; 315/307; 315/DIG. 7

[58] Field of Search ..... 315/224, 247, 315/209 R, 244, 291, 307, DIG. 4, DIG. 7; 363/26, 44, 89, 124; 323/222, 207

[56] References Cited

U.S. PATENT DOCUMENTS

| | | | |
|---|---|---|---|
| 4,222,096 | 9/1980 | Capewell | 363/44 |
| 4,277,728 | 7/1981 | Stevens | 315/307 |
| 4,384,321 | 5/1983 | Rippel | 363/124 |
| 4,560,908 | 12/1985 | Stupp et al. | 315/219 |
| 4,683,529 | 7/1987 | Bucher, II | 363/44 |
| 4,885,675 | 12/1989 | Henze et al. | 363/26 |
| 5,045,991 | 9/1991 | Dhyanchand et al. | 363/89 |
| 5,146,396 | 9/1992 | Eng et al. | 363/16 |
| 5,291,119 | 3/1994 | Cowett, Jr. | 323/207 |
| 5,349,284 | 9/1994 | Whittle | 323/207 |
| 5,359,274 | 10/1994 | Bandel | 315/247 X |
| 5,359,277 | 10/1994 | Cowett, Jr. | 323/207 |
| 5,363,020 | 11/1994 | Chen et al. | 315/209 R |
| 5,394,064 | 2/1995 | Ranganath et al. | 315/209 R |
| 5,404,093 | 4/1995 | Cowett, Jr. | 323/207 |
| 5,416,687 | 5/1995 | Beasley | 363/44 |
| 5,430,364 | 7/1995 | Gibson | 323/207 |
| 5,446,646 | 8/1995 | Miyazaki | 363/89 |
| 5,471,117 | 11/1995 | Ranganath et al. | 315/247 |
| 5,489,837 | 2/1996 | Arakawa | 323/207 |
| 5,519,289 | 5/1996 | Katyl et al. | 315/224 |
| 5,519,306 | 5/1996 | Itoh et al. | 323/222 |
| 5,650,694 | 7/1997 | Jayaraman et al. | 315/225 |
| 5,694,007 | 12/1997 | Chen | 315/247 |

OTHER PUBLICATIONS

Motorola, Inc., *Motorola Semiconductor Technical Data,* 1993, Brochure.

Bob Christianson, *Basic Design Calculations for an Electronic Ballast PFC Circuit,* Aug. 1990, pp. 32–35.

*Primary Examiner*—Don Wong
*Assistant Examiner*—Haissa Philogene
*Attorney, Agent, or Firm*—Palmatier, Sjoquist, Voigt & Christensen, P.A.

[57] ABSTRACT

A constant light output ballast circuit capable of regulating lamp current to a substantially constant level independent of the number of fluorescent lamps on load. The circuit incorporates a power factor control circuit and an electronic ballast circuit having a secondary winding on its output transformer. The voltage on the secondary winding, which is proportional to the ballast circuit's output voltage, is fed back to the power factor control circuit to regulate the DC output voltage supplied to the electronic ballast circuit and thereby maintain a constant lamp current.

18 Claims, 4 Drawing Sheets

130
5
D27
22
C30
R26
D28
C31
23
R25
R24
24
11
8
21
1
2
T21
9
10
18
17

CN
FLN
FL3
FL2
FL1
C23
C22
19
120
110
100
140
VIN
3
C30
R26
D28
C31
R25
R24

CONSTANT LIGHT OUTPUT BALLAST CIRCUIT

BACKGROUND

This invention relates to current regulation and more particularly to regulating lamp current to a constant level independent of the number of fluorescent lamps that are added to an electronic ballast.

Electronic ballast circuits are used in the operation of fluorescent lamps. An electronically controlled supply, such as a power factor correction circuit or other type of regulated supply, is used to provide the supply voltage to the electronic ballast circuit. Electronic ballast circuits are usually self-oscillating circuits and generally produce the high output voltage necessary for a fluorescent lamp to arc over. Once the fluorescent lamp arcs, a reactive impedance is used to limit, or ballast, the current through the lamp. This reactive impedance is reflected back into the oscillator circuitry causing the oscillator to shift in frequency. The greater the number of lamps added to the circuit, the greater the shift in frequency. A change from one to four lamps can create an oscillator frequency change of 25%, approximately a drop from 32 kHz to 24 kHz. This drop in frequency cuts the lamp current proportionately. Since most lamp manufacturers will not warrant their product for operating currents above 10% of the rated operating current, electronic ballasts are, in general, limited to lighting four lamps running at 80% of their rated current yielding only 80% of their light output.

The usual method to increase this light output is to increase the frequency of oscillation or increase the size of the lead-in, ballasting, capacitor to the fluorescent lamp. However, this method requires the swapping out of components and is difficult to maintain and to operate. Another alternative is to increase the supply voltage to the output circuit. However, this can be costly in reference to the high voltage components that may be necessary.

In view of the above, there is a need for a ballast circuit that can maintain a substantially constant lamp current regardless of the number of lamps on the circuit.

SUMMARY

A constant light output ballast circuit capable of regulating lamp current to a substantially constant level independent of the number of fluorescent lamps on load. The circuit incorporates a power factor control circuit, an electronic ballast circuit and a feedback circuit. The ballast circuit uses the power factor control circuit as its variable DC power supply. The feedback circuit detects and provides the power factor control circuit with the ballast circuit's output voltage requirements.

An object and advantage of the present invention is that the constant light output ballast circuit is of a relatively simple design that is easy to understand and build with standard components.

Yet another object and advantage of the present invention is that the lamp current of the fluorescent lamps that are connected to the constant light output ballast circuit can be regulated to a substantially constant level, meaning they can be regulated to within 1% of the desired output.

Yet another object and advantage of the present invention is that by adjusting the feedback circuit elements the lamp current can be safely set at its maximum current, 110% of rated lamp current. Thus, the constant light output ballast running three lamps at 110% of current can yield as much or more light (110% times 3=330%) as a standard ballast circuit capable of running four lamps at 80% of rated current (80% times 4=320%). Using three lamps instead of four yields obvious cost reductions as well as added light by reducing the light interference of the added lamp.

Yet another object and advantage of the present invention is that a ballast capable of driving more than four lamps is practical.

DRAWINGS

These and other features, aspects, and advantages of the present invention will become better understood with regard to the following description, appended claims, and accompanying drawings where:

FIG. 2 depicts in detail the extended feedback circuit; and

DETAILED DESCRIPTION

A constant light output ballast circuit 100 comprising a power factor control circuit 110 (e.g. variable DC power supply), an electronic ballast circuit 120 and a feedback circuit 140.

Note that like elements and like nodes are numbered consistently throughout each of the representative circuits.

Figures 3, 4:
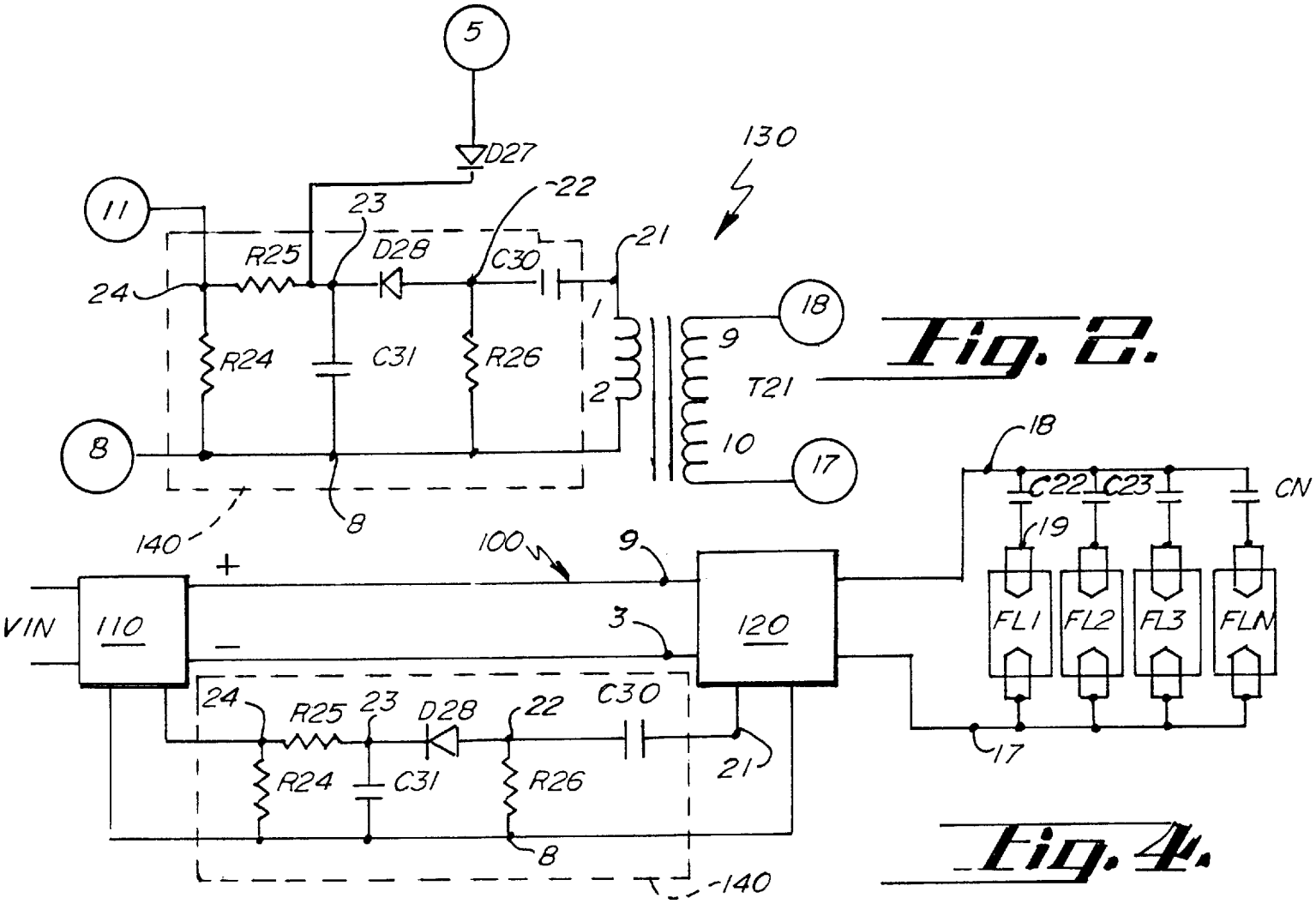
FIG. 3 depicts an industrial application-type constant light output ballast circuit, incorporating an AC phase timing network.
FIG. 4 depicts the basic layout of the constant light output ballast circuit with the feedback circuit shown in detail.
Figure 3:
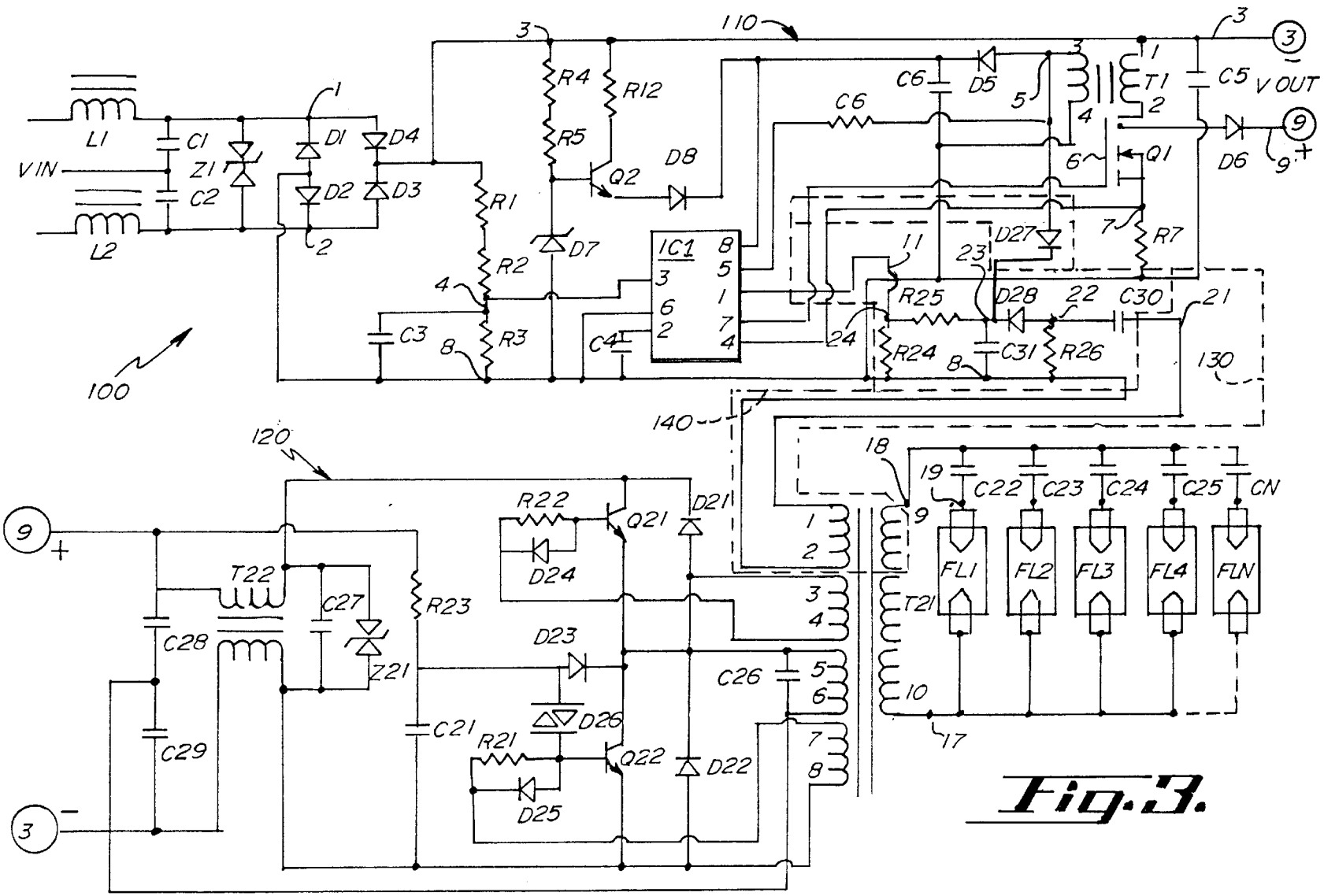

The basic layout of the constant light output ballast circuit is shown in FIG. 4. As can be seen, the unique part of the circuit 100 is the feedback circuit 140. This feedback circuit 140 may be used with any type of power factor control circuit 110 (operating as the DC power supply) and any type of electronic ballast 120. The feedback circuit 140 is comprised of: a capacitor C30, which is the feedback circuit's frequency compensating impedance, referenced between nodes 21 and 8; a resistor R26, which is the peak voltage resistance, referenced between nodes 22 and 8; a diode D28, which is the peak voltage detector, referenced between nodes 22 and 23; a capacitor C31, which is the peak voltage storage device, referenced between nodes 23 and 8; and finally, a resistor R25 referenced between nodes 23 and 24, and a resistor R24 referenced between nodes 24 and 8 which together form the feedback circuit's voltage divider.

The feedback circuit 140 works under the following principles of operation. First, it is assumed that the voltage across nodes 17 and 18 is proportional to the voltage across nodes 9 and 3, that the voltage across nodes 9 and 3 is proportional to the voltage across nodes 24 and 8, and that the voltage across nodes 24 and 8 is proportional to the voltage across nodes 21 and 8. Second, with respect to the fluorescent lamps (e.g. FL1, FL2, FL3 . . . FLn), the light output of the fluorescent lamp is directly proportional to the fluorescent lamp current, $I_L$. Further, the fluorescent lamp voltage, after initial striking of the arc, is nearly constant independent of the fluorescent lamp current. Third, the RMS (root mean square) current through the lamp is $I_L$ (RMS)= $((V_{18\text{-}17})^2-(V_{19\text{-}17}))^{0.5}(2\pi fC)$, where $V_{18\text{-}17}$ is the voltage output of the electronic ballast across nodes 18 and 17, $V_{19\text{-}17}$ is the voltage across the fluorescent lamp (e.g. voltage across FL1 at nodes 19 and 17) and $1/2\pi fC$ is the impedance of the ballast capacitor (e.g. C22) at a certain frequency, f.

Since the voltage across nodes 21 and 8 is proportional to the voltage across nodes 17 and 18, if C31 and R26 are then chosen to be a ratio of the ballast capacitor, C22, and the apparent resistance of the fluorescent lamp (the apparent resistance equal to $V_{19\text{-}17}/I_L$), then the voltage drop across R26, which is the voltage across nodes 22 and 8, is exactly representative of the current through the fluorescent lamps (e.g. FL1, FL2, FL3, . . . FLn). Diode D28 detects the peak voltage across R26. This voltage, which again is the voltage across nodes 22 and 8, is stored on C31. The voltage stored on C31 is then divided down by R25 and R24 to a suitable voltage level for the power factor control circuit 110. The power factor control circuit 110 (which is the variable DC power supply), will regulate its output to maintain this voltage level between nodes 11 and 8. Thereby, the output voltage of the ballast circuit 120 across nodes 17 and 18 is maintained to keep the current through the fluorescent lamps (FL1, FL2, FL3, . . . FLn) substantially constant (constant meaning within 1% of desired output). As such, in the most basic terms, the feedback circuit is a circuit portion configured to detect and provide the power factor control circuit 110 with the ballast circuit's output voltage requirements.

Figure 1A:
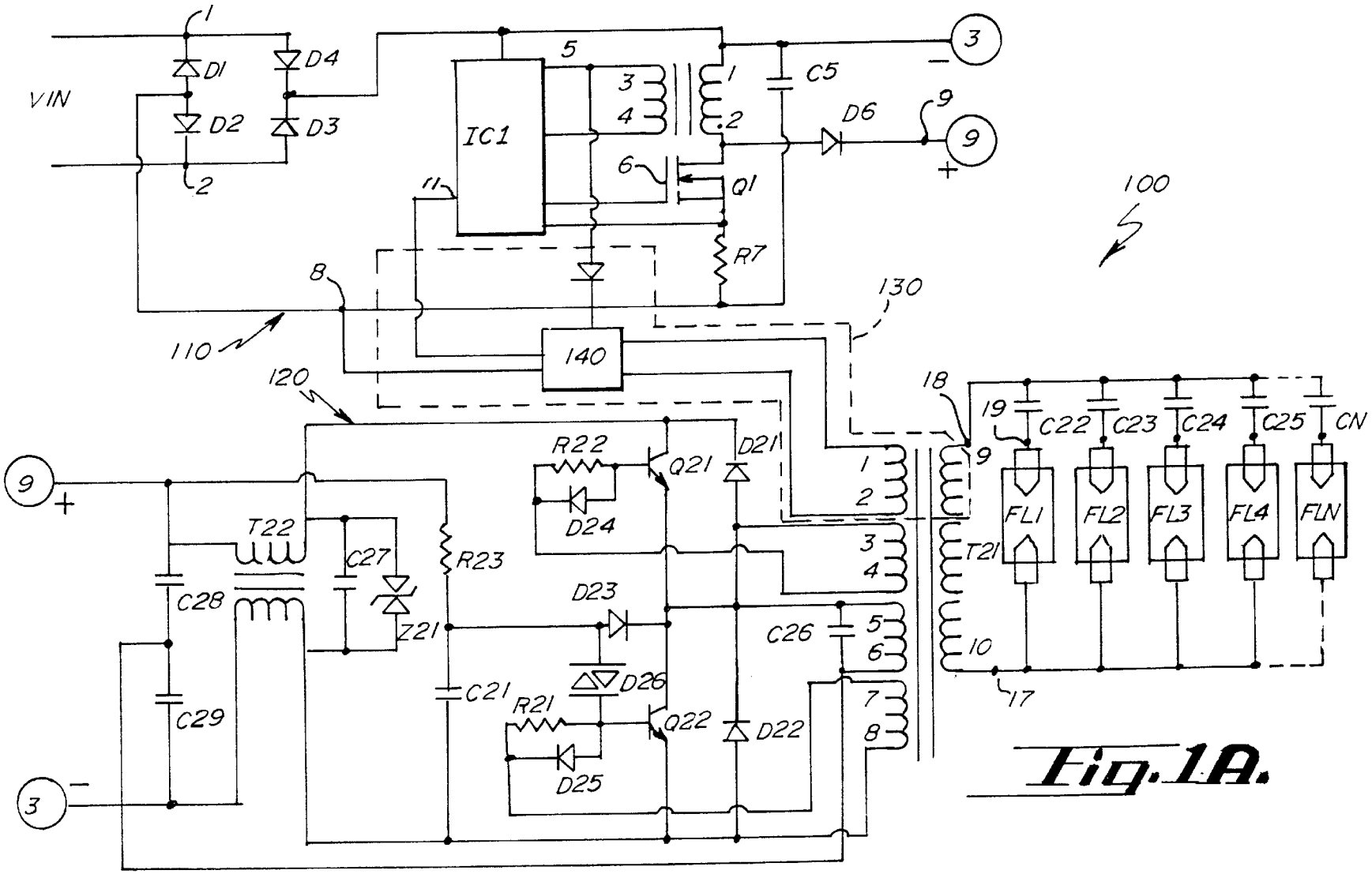
FIG. 1A depicts the constant light output ballast circuit with a low in-rush current, power factor correction circuit that does not incorporate an AC phase timing network.

An example of the feedback circuit 140 as applied to a specific power factor control circuit 110 and electronic ballast circuit 120 is described below:

The layout of a variable DC power supply, which in this case is a unique low in-rush current, power factor control circuit 110, can be described as follows (see FIG. 1A): an AC mains input voltage, Vin, is referenced between nodes 1 and 2 of a bridge rectifier comprising D1, D2, D3 and D4. The bridge rectifier acts as a first rectifier, with the cathode and anode sides of the bridge rectifier referenced to nodes 3 and 8 (ground) respectively; a high frequency bypass capacitor, C5, is referenced between nodes 3 and 8 and performs the function of a filter; a non-saturating inductor, T1, having winding 1–2 and winding 3–4, performing as the first energy storage device, is referenced between nodes 3 and 10; a power factor control chip or integrated circuit, IC1 is referenced between nodes 3 and 8; a switch, Q1, is referenced between nodes 10 and 7 and has an enable/disable input from IC1 at node 6; a current limiter, R7 is referenced between nodes 7 and 8; a recovery diode, D6, performing the function of a second rectifier, is referenced between nodes 9 and 10; and the feedback circuit 140 is referenced between nodes 11 and 8. The DC output voltage of the power factor control circuit 110 is referenced between nodes 9 and 3, and is fed to energy storage capacitors, C28 and C29, within the electronic ballast circuit 120.

Especially notable within the above described circuit is the fact that the DC output voltage and the ballast circuit's energy storage capacitors C28 and C29 are referenced between node 9 and node 3, node 3 being the cathode side of the bridge rectifier. Positioning C28 and C29 with reference to node 3 limits a high in-rush current and rapid charging of the capacitors when the AC mains input voltage, Vin, is applied to the circuit. In this configuration, the low in-rush current power factor control circuit can use the inductance of the first energy storage device, T1, to limit the amount of charging current going to C28 and C29 of the ballast circuit 120.

Figure 1B:
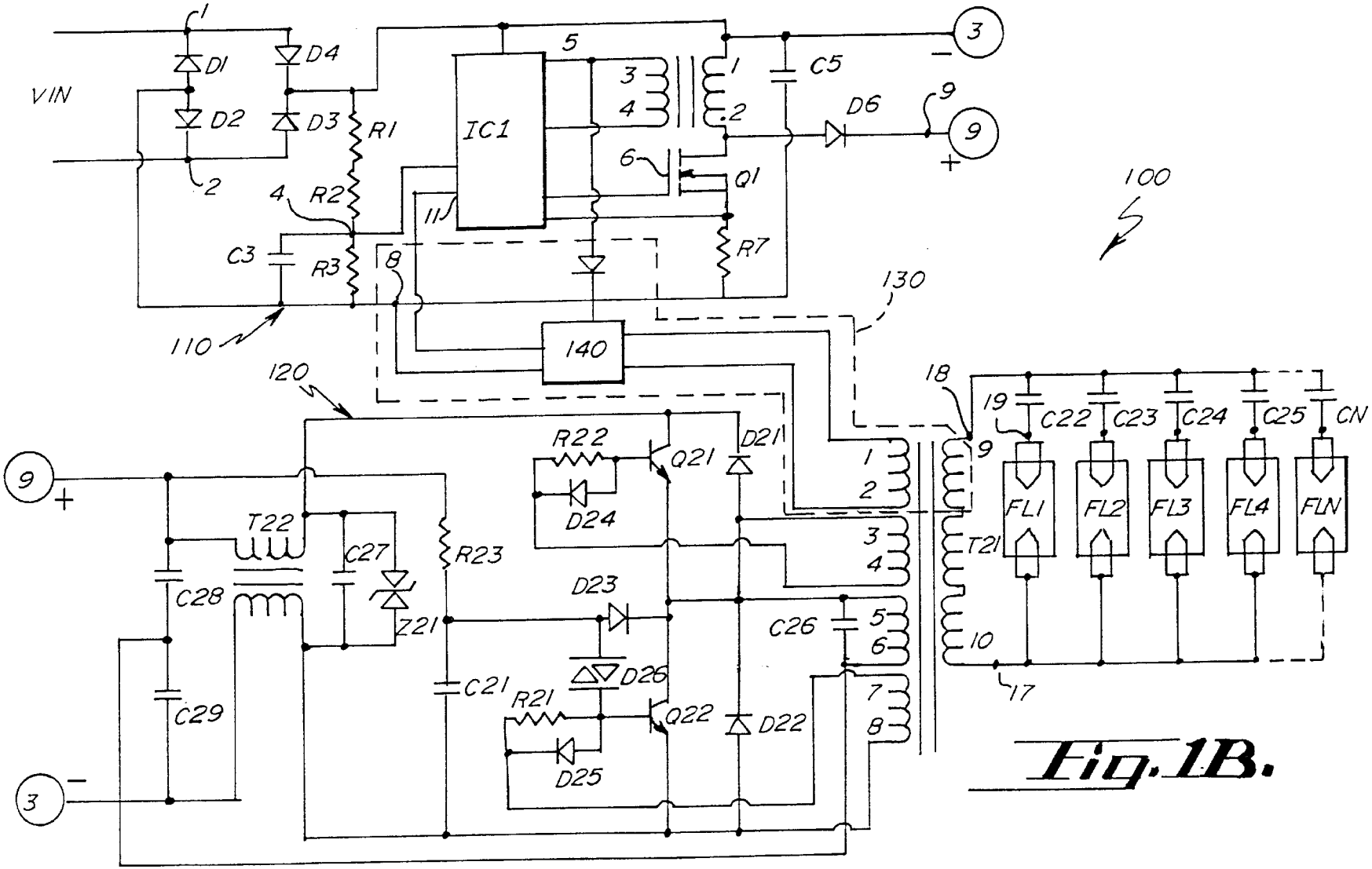
FIG. 1B depicts the constant light output ballast circuit with a low in-rush current, power factor correction circuit that does incorporate an AC phase timing network.

FIG. 1B depicts the low in-rush current, power factor control circuit 110 with an additional AC phase timing network. The network comprises two resistors, R1 and R2, which lie in series between nodes 3 and 4 as well as a resistor, R3, and capacitor, C3 which lie in parallel between nodes 4 and 8. R1, R2, and R3 from a voltage divider network that takes the full wave rectified AC voltage from the first rectifier and makes the amplitude acceptable to the power factor control chip, IC1. R1 and R2 could be replaced with one resistor of sufficient voltage rating. C3 is used as a noise filtering capacitor. A resulting AC phase signal at node 4 is input to the power factor control chip, IC1, and is used to assist in modulating the frequency of the switching means Q1 (discussed further below). The AC phase timing network may or may not be necessary to the circuit depending on the IC used for the power factor control. The MC34262, available from MOTOROLA®, used in the circuit of FIG. 3 requires this AC phase timing network and as such, further description of the operation of the low in-rush current, power factor control circuit 110 will include the AC phase timing network and the MC34262. The publication entitled *Motorola Semiconductor Technical Data, Advance Information, Power Factor Controllers* (© Motorola 1993) describing the operation of the MC34262 is hereby incorporated by reference. Note, however, that an IC that is able to accept the AC signal without amplitude modification will work similarly to an IC that requires and has an AC phase timing network.

Operation of the low in-rush current, power factor control circuit 110 of FIG. 1B may now be appreciated. The AC input voltage, Vin, at nodes 1 and 2 is full wave rectified by the first rectifier, the bridge rectifier. The positive output of the first rectifier at node 3 is then fed to the following: (1) the AC phase timing network to adapt the AC signal for the power factor control chip, IC1 assuming an MC34262; (2) the filter, C5; (3) the first energy storage device, T1; and (4) the bottom end of the energy storage capacitors, C28 and C29. The voltage potential at node 3, with respect to node 8, rises and falls as determined by the rectified voltage of the first rectifier. The voltage at node 9 is determined by the amount of energy transferred from winding 1–2 of the first energy storage device, T1, to the energy storage capacitors C28 and C29.

Note that when the switch, Q1, is initially enabled current is drawn through winding 1–2 of the first energy storage device, T1. Winding 1–2 of T1 will continue to draw current until the power factor control chip, IC1, senses from the current limiter, R7, that R7 has reached a maximum predetermined voltage. Once that predetermined voltage is reached, the power factor control chip, IC1, disables Q1 through Q1's enable/disable input. With Q1 disabled, the energy contained in winding 1–2 of T1 flies back and charges the energy storage capacitors of the ballast circuit, C28 and C29, between nodes 3 and 9. Thus, the continuing regulation of voltage across C28 and C29 is performed strictly by controlling the frequency of the enable/disable cycle of switch Q1 by IC1. This enable/disable cycle is determined by two factors: (1) the AC phase signal entering the power factor control chip, IC1, at node 4; and (2) by the amount of energy required by the ballast circuit 120 across nodes 3 and 9. The power factor control chip, IC1, is able to determine this amount of load energy by use of the feedback circuit 140, see FIGS. 2 and 3.

The basic feedback circuit 140 in this instance further incorporates a secondary winding on the ballast circuit output transformer T21 and a blocking diode D27; the combination of all three creating an extended feedback circuit 130. Note that the ballast circuit 120 is of a basic design that is well understood by those skilled in the art. In general terms, the ballast circuit 120 is a self-oscillating circuit that produces high voltage across nodes 17 and 18 causing the fluorescent lamps, FL1, FL2, FL3 . . . FLn to arc over. In the circuits of FIGS. 2 and 3, secondary winding 1–2 of transformer T21 is used as the feedback winding. It yields a voltage that is proportional to the output voltage of the ballast at nodes 17–18. The secondary winding voltage is fed back through the extended feedback circuit 130 comprised of: the capacitor C30, which is the feedback circuit's frequency compensating impedance, referenced between nodes 21 and 8; the resistor R26, which is the peak voltage resistance, referenced between nodes 22 and 8; the diode D28, which is the peak voltage detector, referenced between nodes 22 and 23; the capacitor C31, which is the peak voltage storage device, referenced between nodes 23 and 8; and finally, the resistor R25 referenced between nodes 23 and 24, and the resistor R24 referenced between nodes 24 and 8 which together form the feedback circuit's voltage divider, see specifically FIGS. 2 and 3. Also present within the extended feedback circuit 130 is the diode D27 that serves as a blocking diode to isolate the voltage of windings 3–4 of T1. Note that the use of a secondary winding, such as winding 1–2 of transformer T21, is the most convenient way to determine the ballast circuit 120 output voltage however, other methods may also be used. Further note that the use of diode D27 was necessary due to the selection of the power factor control circuit 110. Alternative choices for the power factor control circuit 110 may or may not require the use of such a diode; one skilled in the art can determine the appropriateness of a blocking diode like D27.

The extended feedback circuit 130 with its secondary winding and blocking diode works under the same principles of operation as the feedback circuit 140. First, it is assumed that the voltage across nodes 17 and 18 is proportional to the voltage across nodes 9 and 3, that the voltage across nodes 9 and 3 is proportional to the voltage across nodes 24 and 8, and that the voltage across nodes 24 and 8 is proportional to the voltage across nodes 21 and 8. Second, with respect to the fluorescent lamps (e.g. FL1, FL2, FL3 . . . FLn), the light output of the fluorescent lamp is directly proportional to the fluorescent lamp current, $I_L$. Further, the fluorescent lamp voltage, after initial striking of the arc, is nearly constant independent of the fluorescent lamp current. Third, the RMS (root mean square) current through the lamp is $I_L$ (RMS)= $((V_{18\text{-}17})^2-(V_{19\text{-}17}))^{0.5}(2\pi fC)$, where $V_{18\text{-}17}$ is the current output of the electronic ballast across nodes 18 and 17, $V_{19\text{-}17}$ is the voltage across the fluorescent lamp (e.g. voltage across FL1 at nodes 19 and 17) and $1/2\pi fC$ is the impedance of the ballast capacitor (e.g. C22) at a certain frequency, f.

Since the voltage across nodes 21 and 8 is proportional to the voltage across nodes 17 and 18, if C31 and R26 are then chosen to be a ratio of the ballast capacitor, e.g. C22, and the apparent resistance of the fluorescent lamp (the apparent resistance equal to $V_{19\text{-}17}/I_L$), then the voltage drop across R26, which is the voltage across nodes 22 and 8, is exactly representative of the current through the fluorescent lamps (e.g. FL1, FL2, FL3, . . . FLn). Diode D28 detects the peak voltage across R26. This voltage, which again is the voltage across nodes 22 and 8, is stored on C31. The voltage stored on C31 is then divided down by R25 and R24 to a suitable voltage level for the power factor control circuit 110. This voltage level is typically around 2.5 volts, which is suitable for the MC34262 power factor control chip, the chip used in FIG. 3. The power factor control circuit 110 (operating as the variable DC power supply), will regulate its output to maintain the voltage between nodes 11 and 8 at 2.5 volts. Thereby, the output voltage of the ballast circuit 120 across nodes 17 and 18 is maintained to keep the current through the fluorescent lamps (e.g. FL1, FL2, FL3, . . . FLn) substantially constant (constant meaning within 1% of desired output).

The industrial application-type constant light output ballast circuit 100 of FIG. 3 is described component by component below:

A. Low in-rush current, power factor control circuit 110:

1. L1, L2, C1 and C2 form a basic electromagnetic interference filter. Z1 is a high voltage transient suppressor that provides protection for the load circuits;
2. D1, D2, D3 and D4 form a diode bridge, a first rectifier, for full wave rectifying the AC mains input voltage, Vin;
3. R1, R2 and R3 divide, the full wave rectified voltage at node 3, as referenced to node 8, to a suitable voltage level for the power factor control chip, IC1;
4. C3 filters any noise spikes from entering IC1 at its AC sense input;
5. C4 is used by the power factor control chip, IC1, to stabilize its error amplifier (described below);
6. IC1 is an MC34262 and is the power factor control chip that manipulates the enable/disable cycle of switch Q1 to facilitate good power factor regulation and DC output regulation (pin designations of the MC34262: pin 1—voltage feedback input from node 11; pin 2—error amplifier compensation; pin 3—AC phase signal input; pin 4—current sensing/limiting input; pin 5—ZID, zero current detect input; pin 6—ground; pin 7—switch enable/disable output; pin 8—Vcc);
7. R4 and R5 provide the biasing current for the zener diode D7 and the base current for Q2, which together form a quick start up circuit;
8. D7 is selected for sufficient voltage such that with the Vbe (base-emitter voltage) loss of Q2 and the forward voltage drop of D8 there is still enough voltage to start IC1 into operation;
9. Q2 is an emitter follower circuit that provides rapid charging current for C5, this allows the power factor control chip, IC1, to turn on within one half cycle of power being applied to the AC mains input, Vin;
10. R12 provides current limiting for Q2 and also protects Q2 from transients that might cause failures;
11. D8 prevents Q2's Vbe junction from being reversed voltage stressed if the voltage across C6 rises more than a few volts;
12. C6 is the filter capacitor for the power factor control chip, IC1;
13. D5 is used to rectify the voltage from windings 3–4 of T1. C6 stores the charge that D5 delivers;
14. R6 limits the current going into the ZID input of the power factor control chip, IC1;
15. T1 is the energy storage device. It functions to store the energy being taken from the AC mains input and then transfers that energy to C28 and C29. Windings 1–2 of T1 are used for the energy transfer function. Windings 3–4 of T1 have a multi-purpose function. One purpose is to indicate to the power factor control chip that the energy in T1 has dropped to zero. This is indicated when the voltage on winding 3–4 goes to zero from a positive level. Another purpose of winding 3–4 is to provide efficient power to IC1;
16. Q1 is the switch. It is the transistor switch that charges up T1's windings with stored energy and then releases the stored energy to be transferred to C28 and C29. Q1 is depicted as a MOSFET, however, other semiconductor switches could be used in place of the MOSFET;

17. R7 is the current limiter and is used for sensing the current in Q1 and T1. This current sensing prevents the over stressing of Q1. In addition, it also limits the maximum in-rush current under normal operations. By selecting this value properly along with selecting the inductance in T1, the in-rush current can be set so that it does not exceed the maximum limits under normal conditions;
18. C5 is the high frequency bypass capacitor and is used as a low impedance path to reduce the switching transients when Q1 switches from enabled to disabled and vice-versa;
19. D6 is the second rectifier and provides half wave rectification for charging C28 and C29 to their proper level;

B. Extended Feedback Circuit 130:

20. C30 stores the energy received from the secondary winding 1–2 of the ballast circuit 120, it is the feedback circuit's frequency compensating impedance;
21. D27 is a blocking diode that isolates the voltage of windings 3–4 of T1 if capacitor C30 and resistor R26 have sufficient voltage across them. However, if the feedback voltage is insufficient from the electronic ballast, then the voltage across windings T1 will rise until D27 is forward biased and forces the feedback voltage at the junction of R25, R24 and the input pin, pin 1, of the power factor control IC to the reference voltage, Vref (approximately 2.5 volts for an MC34262);
22. D28 detects the peak voltage across R26, which is the peak voltage resistance;
23. R24 and R25 form the voltage divider that divides the DC voltage across C31, the peak voltage storage device, down to the reference voltage, Vref (approximately 2.5 volts for the MC34262);

Electronic ballast circuit 120:

24. C28 and C29 are the energy storage devices for the electronic ballast. In addition, they form a voltage divider for a half bridge circuit;
25. T22 provides the high frequency impedance for sinusoidal oscillation to take place;
26. C27 catches the switching spikes during the switching transitions from transistor to transistor;
27. R23, C21, and D26 provide a starting pulse to start Q21 and Q22 into oscillation. R23 charges C21 up until the diac D26 fires. This dumps a charge of base current into Q22. Q22 switches on and dumps the rest of C21's charge through D23 into its collector. In addition, the current is also drawn through the tank circuit of C26 and T21 primary winding. Causing the circuit to ring and then start oscillating.
28. R22 and R21 are the base biasing resistors being driven by their respective windings on T21;
29. D24 and D25 are base charge sweep diodes that pull the base charge out upon turn off of the transistors, Q21 and Q22;
30. D21 and D33 are commutation diodes for Q21 and Q22 respectively;
31. C26 is part of a tank circuit controlling the resonant frequency with no load;
32. T21 is the output transformer. The ballast capacitors (e.g. C22, C23, C24, . . . Cn) have their values multiplied as a function of the square of the turns ratio of the transformer. These values reflect themselves into the resonant circuit. Therefore, as the number of lights (e.g. FL1, FL2, FL3, . . . FLn) are added to the ballast the frequency of oscillation decreases;
33. A secondary winding, winding 1–2, on the output transformer T21 is used to sense the ballast circuit's output voltage level that is then fed through the extended feedback circuit 130;

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed:

1. A constant light output ballast circuit, for maintaining the output of an electronic ballast at a substantially constant level independent of the fluorescent lamp load on the ballast, comprising:

(a) a power factor control circuit;

(b) a ballast circuit, said ballast circuit having an output voltage requirement, said ballast circuit adapted to use said power factor control circuit as its variable DC (direct current) power supply; and (c) a circuit portion that is voltage-dependent and configured to detect and provide said power factor control circuit with said ballast circuit's output voltage requirement; whereby said power factor control circuit may provide said ballast circuit with the power to regulate a substantially constant fluorescent lamp current.

2. The circuit of claim 1, wherein said ballast circuit has a transformer with a secondary winding and wherein said circuit portion is adapted to use said secondary winding to detect said ballast circuit's output voltage requirements.

3. The circuit of claim 1, wherein said circuit portion comprises a frequency compensating impedance, a peak voltage resistance, a peak voltage detector, a peak voltage storage device and a voltage divider.

4. The circuit of claim 1, wherein said power factor control circuit comprises a power factor control integrated circuit.

5. The circuit of claim 4, wherein said circuit portion is adapted to conform said ballast circuit's output voltage requirement to a voltage level suitable for input to said power factor control integrated circuit.

6. The circuit of claim 1, wherein said power factor control circuit comprises a low in-rush current, power factor control circuit having a bridge rectifier with a cathode side and a DC (direct current) output, said DC output referenced to said cathode side of said bridge rectifier.

7. The circuit of claim 1, wherein said substantially constant fluorescent lamp current is regulated to within 1% of a desired output.

8. A constant light output ballast circuit, for maintaining the output of an electronic ballast at a substantially constant level independent of the fluorescent lamp load on the ballast, comprising:

(a) a power factor control circuit;

(b) a ballast circuit, said ballast circuit having an output voltage requirement, said ballast circuit adapted to use said power factor control circuit as its variable DC (direct current) power supply; and (c) a feedback circuit configured to detect and provide said power factor control circuit with said ballast circuit's output voltage requirement so that the power factor control circuit may provide said ballast circuit with the power to regulate a substantially constant fluorescent lamp current, said feedback circuit comprising a frequency compensating impedance, a peak voltage resistance, a peak voltage detector, a peak voltage storage device and a voltage divider.

9. The circuit of claim 8, wherein said ballast circuit has a transformer with a secondary winding and wherein said feedback circuit is adapted to use said secondary winding to detect said ballast circuit's output voltage requirement.

10. The circuit of claim 8, wherein said low in-rush current, power factor control circuit comprises a power factor control integrated circuit.

11. The circuit of claim 10, wherein said feedback circuit is adapted to conform said detected ballast circuit's output voltage requirement to a voltage level suitable for input to said power factor control integrated circuit.

12. The circuit of claim 8, wherein said power factor control circuit comprises a low in-rush current, power factor control circuit having a bridge rectifier with a cathode side and a DC (direct current) output, said DC output referenced to said cathode side of said bridge rectifier.

13. The circuit of claim 8, wherein said substantially constant fluorescent lamp current is regulated to within 1% of a desired output.

14. A constant light output ballast circuit, for maintaining the output of an electronic ballast at a constant level independent of the fluorescent lamp load on the ballast, comprising:

(a) a power factor control circuit;

(b) a ballast circuit, said ballast circuit having an output voltage requirement, said ballast circuit having a transformer with a secondary winding, said ballast circuit adapted to use said power factor control circuit as its variable DC (direct current) power supply; and (c) a feedback circuit, said feedback circuit adapted to use said secondary winding for detecting and providing said power factor control circuit with the ballast circuit's output voltage requirement so that the power factor control circuit may provide said ballast circuit with the power to regulate a substantially constant output voltage, said feedback circuit comprising a frequency compensating impedance, a peak voltage resistance, a peak voltage detector, a peak voltage storage device and a voltage divider.

15. The circuit of claim 14, wherein said power factor control circuit comprises a low in-rush current, power factor control circuit having a bridge rectifier with a cathode side and a DC (direct current) output, said DC output referenced to said cathode side of said bridge rectifier.

16. The circuit of claim 14, wherein said power factor control circuit comprises a power factor control integrated circuit.

17. The circuit of claim 16, wherein said feedback circuit is adapted to conform said detected ballast circuit's output voltage requirement to a voltage level suitable for input to said power factor control integrated circuit.

18. The circuit of claim 14, wherein said substantially constant fluorescent lamp current is regulated to within 1% of a desired output.

* * * * *

UNITED STATES PATENT AND TRADEMARK OFFICE

CERTIFICATE OF CORRECTION

PATENT NO. : 5,874,809
DATED : Feb. 23, 1999
INVENTOR(S) : Thomas E. Hagen

It is certified that error appears in the above-identified patent and that said Letters Patent is hereby corrected as shown below:

col. 5, line 43: please delete the word "current" and in its place insert --voltage-- col. 8, line 31: please delete the word "requirements" and in its place insert --requirement-- col. 8, line 32: please insert --further-- after the word "portion"

col. 8, lines 34-35: please delete "a peak voltage storage device"

Signed and Sealed this

Twenty-fifth Day of July, 2000

*Attest:*

*Attesting Officer*

Q. TODD DICKINSON

*Director of Patents and Trademarks*